US012410536B2

(12) United States Patent
Nakamura et al.

(10) Patent No.: US 12,410,536 B2
(45) Date of Patent: Sep. 9, 2025

(54) PLATING APPARATUS, PLATING METHOD, AND METHOD FOR PRODUCING WIRE ROD HAVING THE SURFACE PLATED

(71) Applicants: TEIKOKU ION CO., LTD, Higashiosaka (JP); NATIONAL INSTITUTES FOR QUANTUM SCIENCE AND TECHNOLOGY, Chiba (JP); OKAZAKI MANUFACTURING COMPANY, Kobe (JP)

(72) Inventors: Takashi Nakamura, Higashiosaka (JP); Takuya Kawawaki, Higashiosaka (JP); Mitsuhiko Terashita, Nishimuro-gun (JP); Masahiko Hirakami, Higashiosaka (JP); Masafumi Hojo, Higashiosaka (JP); Ryosuke Nakamura, Higashiosaka (JP); Masao Ishikawa, Chiba (JP); Taketo Nishikawa, Kobe (JP); Toshihiko Ryo, Kobe (JP)

(73) Assignees: TEIKOKU ION CO., LTD, Higashiosaka (JP); NATIONAL INSTITUTES FOR QUANTUM SCIENCE AND TECHNOLOGY, Chiba (JP); OKAZAKI MANUFACTURING COMPANY, Kobe (JP)

( * ) Notice: Subject to any disclaimer, the term of this patent is extended or adjusted under 35 U.S.C. 154(b) by 369 days.

(21) Appl. No.: 17/798,230

(22) PCT Filed: Aug. 6, 2021

(86) PCT No.: PCT/JP2021/029413
§ 371 (c)(1),
(2) Date: Aug. 8, 2022

(87) PCT Pub. No.: WO2022/039060
PCT Pub. Date: Feb. 24, 2022

(65) Prior Publication Data
US 2023/0120376 A1 Apr. 20, 2023

(30) Foreign Application Priority Data
Aug. 18, 2020 (JP) ..... 2020-137794

(51) Int. Cl.
*C25D 17/06* (2006.01)
*C25D 5/02* (2006.01)
(Continued)

(52) U.S. Cl.
CPC ..... *C25D 17/02* (2013.01); *C25D 5/022* (2013.01); *C25D 5/10* (2013.01); *C25D 7/0607* (2013.01);
(Continued)

(58) Field of Classification Search
None
See application file for complete search history.

(56) References Cited

U.S. PATENT DOCUMENTS 2,356,639 A * 8/1944 Woitscheck ..... C25D 17/06 205/68
3,642,602 A * 2/1972 Schweizerhof ..... C25D 5/003 204/229.8
(Continued)

FOREIGN PATENT DOCUMENTS

JP 55006451 A * 1/1980
JP 2004-27366 A 1/2004
(Continued)

OTHER PUBLICATIONS

English translation JP 2004027366 (Year: 2004).*
(Continued)

*Primary Examiner* — Stefanie S Wittenberg

(74) *Attorney, Agent, or Firm* — WHDA, LLP

(57) ABSTRACT

A plating apparatus (10) is disclosed including a plating tank (9), cathodes (1*a* to 1*f*), a holding mechanism (2), at least one anode (3), and a rotation mechanism (4). The plating tank (9) contains an annularly or helically wound substrate (90) together with a plating solution. The cathodes (1*a* to 1*f*) are placed inside the plating tank (9). The holding mechanism (2) holds the cathodes (1*a* to 1*f*) at positions electrically connected to the outer periphery of the substrate (90) and holds the substrate (90) via the cathodes (1*a* to 1*f*). The anode (3) is placed at least on the inner periphery side of the substrate (90) held by the holding mechanism (2). The rotation mechanism (4) rotates at least either the substrate (90) and cathodes (1*a* to 1*f*) held by the holding mechanism (2) or the anode (3), or both, around the axis of the wound substrate (90).

12 Claims, 8 Drawing Sheets

(51) Int. Cl.

| | |
|---|---|
| ***C25D 5/10*** | (2006.01) |
| ***C25D 7/06*** | (2006.01) |
| ***C25D 17/00*** | (2006.01) |
| ***C25D 17/02*** | (2006.01) |
| ***C25D 17/12*** | (2006.01) |
| ***C25D 21/10*** | (2006.01) |

(52) U.S. Cl.
CPC ..... *C25D 17/007* (2013.01); *C25D 17/06* (2013.01); *C25D 17/12* (2013.01); *C25D 21/10* (2013.01)

(56) References Cited

U.S. PATENT DOCUMENTS

| | | | | | |
|---|---|---|---|---|---|
| 3,676,322 | A | * | 7/1972 | Kamata | C25D 7/0607 205/138 |
| 4,640,758 | A | * | 2/1987 | Held | B44B 5/026 204/272 |
| 2004/0001922 | A1 | | 1/2004 | Meyer | |
| 2006/0137987 | A1 | | 6/2006 | Miyazawa et al. | |
| 2016/0230299 | A1 | | 8/2016 | Sakaida et al. | |

FOREIGN PATENT DOCUMENTS

| | | | | | |
|---|---|---|---|---|---|
| JP | 2006-183085 | A | | 7/2006 | |
| JP | 2010-519413 | A | | 6/2010 | |
| JP | 2012214838 | A | * | 11/2012 | |
| JP | 2015-71816 | A | | 4/2015 | |
| WO | WO-9011389 | A1 | * | 10/1990 | |
| WO | WO-2008103027 | A1 | * | 8/2008 | B21C 47/265 |

OTHER PUBLICATIONS

International Search Report dated Sep. 7, 2021, issued in counterpart International Application No. PCT/JP2021/029413. (2 pages).

* cited by examiner (a) Example (b) Comparative Example

PLATING APPARATUS, PLATING METHOD, AND METHOD FOR PRODUCING WIRE ROD HAVING THE SURFACE PLATED

TECHNICAL FIELD

The present invention relates to an apparatus for electroplating a linear or strip-shaped substrate, a plating method, and a method for producing a wire rod having its surface plated.

BACKGROUND ART

PTL 1 and 2 listed below, for example, disclose known techniques for electroplating linear or strip-shaped wire rods (workpieces), including mineral-insulated (MI) cables. The plating apparatus disclosed in PTL 1 includes a counter-electrode exposed and attached on the outer periphery of a fixed drum. A workpiece is wound around the outer periphery of a rotating drum that houses the fixed drum. The plating apparatus disclosed in PTL 2 includes protrusions formed of a conductive material on a drum electrode. The drum electrode rotates at the same velocity as the carrying velocity of a workpiece, and the workpiece is wound around the outer periphery of the drum electrode.

CITATION LIST

Patent Literature

PTL 1: JP2006-183085A
PTL 2: JP2015-071816A

SUMMARY OF INVENTION

Technical Problem

Recent years have seen demand for more sophisticated quality of plating. Higher precision than ever before has also been required for plating layers to coat wire rods, and plating performed by known plating apparatuses cannot achieve such required precision for wire rods. For example, in the plating apparatuses disclosed in PTL 1 and 2, the contact point between the counter-electrode provided on the outer periphery of the drum and the workpiece, or between the protrusions and the workpiece, is shadowed during plating treatment, which causes the variable in precision of the plating layer in both the longitudinal and radial directions of the wire rod. Additionally, insufficient agitation of the plating solution results in voids and other defects formed inside the plating layer, and such defects greatly change the electrical characteristics of the coated wire rod which varies by location from one section to another section on the wire rod.

The main object of the present invention is to provide a plating apparatus for forming a high-precision plating layer.

The second object is to provide a plating method.

The third object is to provide a method for producing a wire rod having its surface plated.

Solution to Problem

The plating apparatus according to the present invention includes a plating tank, at least one cathode, a holding mechanism, at least one anode, and a rotation mechanism. The plating tank is configured to contain an annularly or helically wound substrate (a material to be plated) together with a plating solution. At least one cathode is placed inside the plating tank. The holding mechanism is configured to hold the cathode at a position which is electrically connected to the outer periphery of the substrate and to hold the substrate via the cathode. At least one anode is placed on the inner periphery side of the substrate held by the holding mechanism. The rotation mechanism is configured to rotate at least either the substrate and cathode held by the holding mechanism or the anode, or both, around the axis of the wound substrate.

Preferably, the holding mechanism is configured to hold the substrate from its outer periphery via the cathode with the substrate being elastically deformed to reduce the diameter of the wound substrate.

More preferably, the holding mechanism is configured to hold a plurality of cathodes spaced from each other in a circumferential direction of the substrate held by the holding mechanism. Additionally, the cathodes each have a shape extending in the axial direction of the wound substrate held by the holding mechanism.

In the plating apparatus according to the present invention, the workpiece (substrate) is annularly or helically wound and held while being pressed against the plurality of cathodes by the elastic restoring force (resilience that acts so as to expand the diameter of the substrate as a reactive force of the elastic deformation) which acts outward in the radial direction of the annular or helical shape. This can reduce the size of the plating tank. Because the cathodes are annularly arranged at intervals, the area in which the workpiece is in contact with the cathodes can also be reduced; thus, a high-precision plating layer can be formed.

Preferably, the holding mechanism includes a plurality of holding members configured to individually hold each cathode, and an annularly structured ring member that integrally holds the holding members spaced from each other in the circumferential direction.

Preferably, the substrate is either a material having a partly provided masking area or a material having no masking area.

Preferably, the ring member includes a mechanism configured to change the holding positions in the circumferential direction at which the ring member holds the individual holding members.

Preferably, the holding mechanism includes a plurality of arms radially extending in the direction from the axial center of the wound substrate held by the holding mechanism to the outer periphery, each arm having its base end connected to the central portion of the ring member and its tip part connected to the ring member.

Preferably, at least a pair of anodes is placed in positions facing each other across the axial center of the wound substrate held by the holding mechanism.

Preferably, the plating apparatus according to the present invention may further include a reciprocating mechanism configured to reciprocate the anodes along the radial direction of the wound substrate held by the holding mechanism.

The plating method according to the present invention includes the step of holding at least one cathode at a position electrically connected to the outer periphery of an annularly or helically wound substrate (a material to be plated) in a plating tank configured to contain a plating solution; and the step of holding the substrate via the cathode with the substrate being elastically deformed to reduce the diameter of the wound substrate; the step of rotating at least either the held substrate and cathode or at least one anode placed on the inner periphery side of the substrate, or both, around the axis of the wound substrate; and the step of conducting the plating treatment on the substrate by applying an electric current across the cathode and the anode while performing the rotating step.

In the plating method according to the present invention, a workpiece (substrate) is annularly or helically wound and held while being pressed against a plurality of cathodes by the elastic restoring force which acts outward in the radial direction of the annular or helical shape. This allows for the use of a small plating tank. Since the cathodes are annularly arranged at intervals, the area in which the workpiece is in contact with the cathodes can also be reduced; thus, a high-precision plating layer can be formed.

Preferably, the plating method according to the present invention may further include the step of changing a position at which the cathode is electrically connected to the substrate every predetermined time.

In a preferable embodiment, the substrate has a plating layer formed on the entire surface thereof and has a partly provided masking area thereon, and the thickness of a plating layer is thicker than the plating layer on the masking area; such layer is formed on the entire area, excluding the masking area.

The method for producing a wire rod having the surface thereof plated according to the present invention includes the step of holding at least one cathode at a position electrically connected to the outer periphery of an annularly or helically wound wire rod in a plating tank configured to contain a plating solution, and holding the wire rod via the cathode with the wire rod being elastically deformed to reduce the diameter of the wound wire rod, the step of rotating at least either the held wire rod and cathode or at least one anode disposed at least on the inner periphery side of the wire rod, or both, around the axis of the wound wire rod, and the step of conducting the plating treatment on the wound wire rod by applying an electric current across the cathode and the anode while performing the rotating step.

Preferably, the plating treatment step includes the step of forming a first plating layer on the entire surface of the wire rod, the step of covering the surface of the formed first plating layer with a masking material so as to expose a part of the surface of the first plating layer, the step of forming a second plating layer on the surface of the first plating layer exposed from the masking material, and the step of removing the masking material after forming the second plating layer.

Advantageous Effects of Invention

The present invention provides a plating apparatus for forming a high-precision plating layer, a plating method, and a method for producing a wired rod having its surface plated.

DESCRIPTION OF EMBODIMENTS

Figure 1:
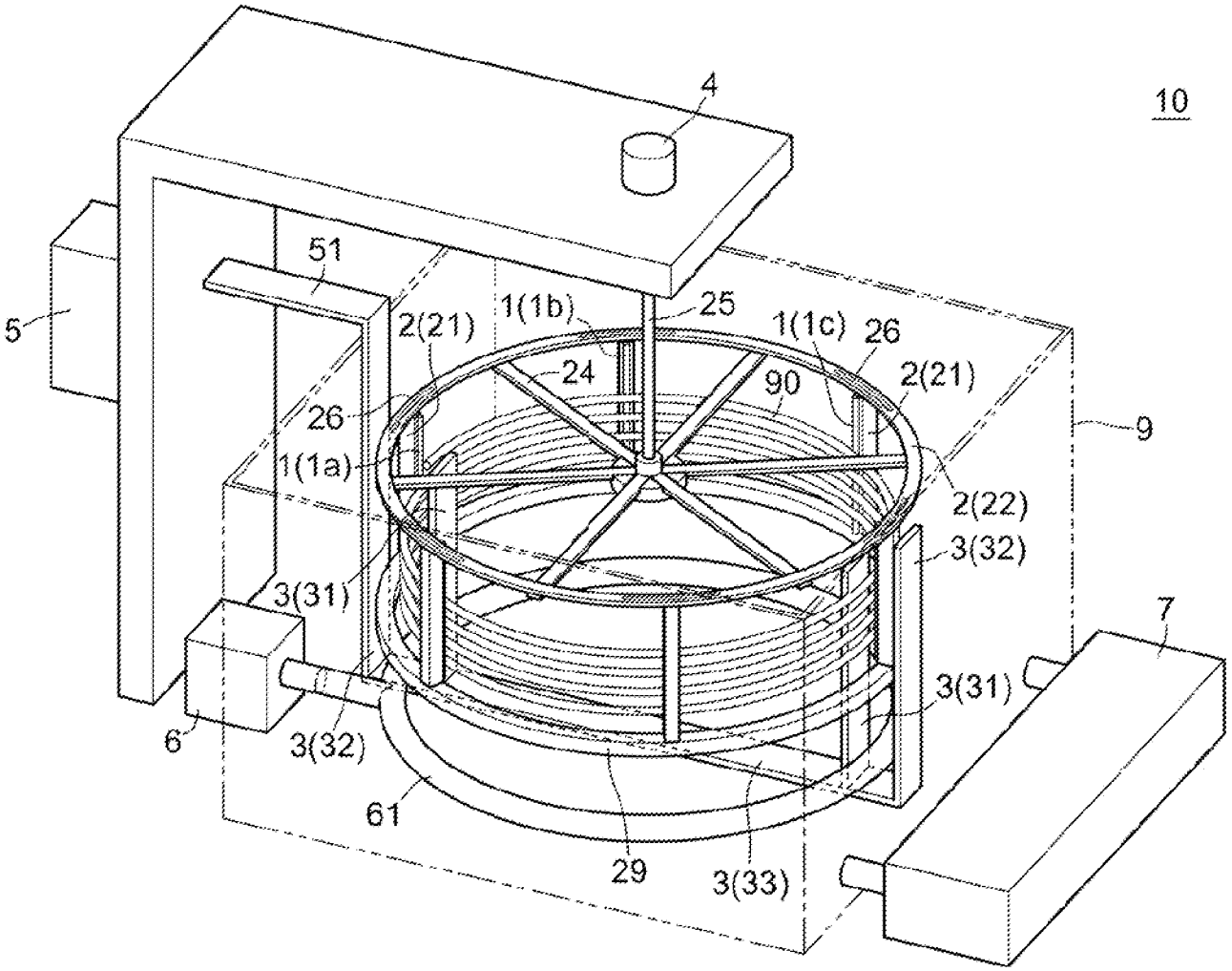
FIG. 1 is a perspective view of a diagrammatic structure of a plating apparatus in an embodiment of the present invention.

The following describes embodiments of the present invention in detail with reference to the attached drawings. In the following description and drawings, the same reference numerals indicate the same or similar component, and thus duplicate description of the same or similar components will be omitted.

(1) Structure of Apparatus

Figure 4:
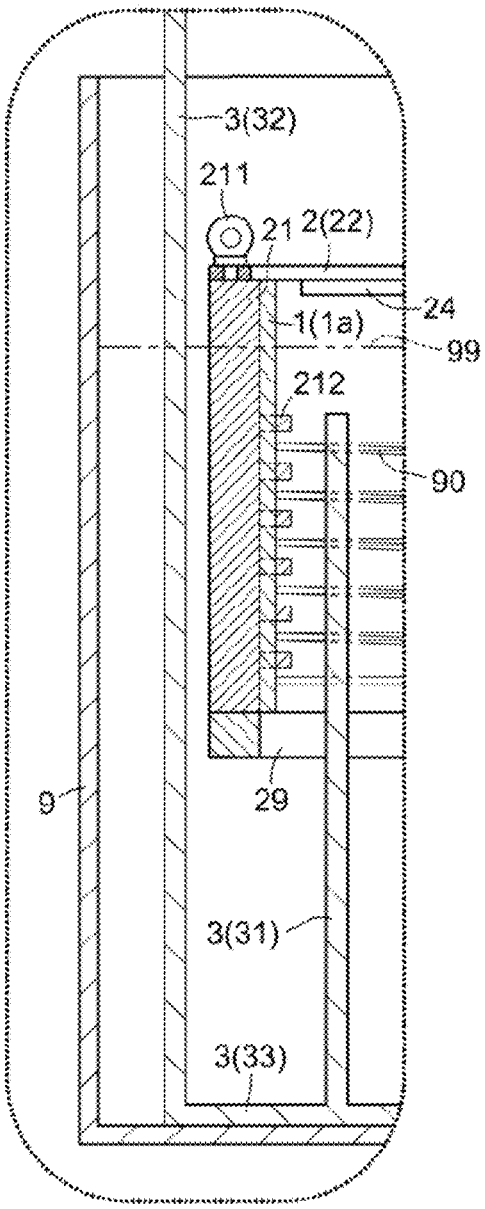
FIG. 4 is an enlarged view of the area enclosed by a single-dotted line in FIG. 3.

FIGS. 1 and 4 schematically show an outline of the plating apparatus according to an embodiment of the present invention.

A plating apparatus 10 in an embodiment includes a plating tank 9; a plurality of cathodes 1 (1*a* to 1*f*); a holding mechanism 2 configured to hold the plurality of cathodes 1 (1*a* to 1*f*) such that the cathodes 1 are spaced from each other and annularly arranged (arranged in a ring shape while spaced from each other); anodes 3 positioned on the inner side of the cathodes 1 with space sufficient to place a workpiece 90, which is an annularly or helically wound substrate (a material to be plated); and a rotation mechanism 4 configured to rotate each cathode 1 with the center of the ring as a rotation center. The holding mechanism 2 holds each cathode 1 at a position electrically connected to the outer periphery of the workpiece 90. Additionally, the holding mechanism 2 holds the workpiece 90 via each cathode 1 from the outer periphery of the workpiece 90 with the workpiece 90 being elastically deformed to reduce the diameter of the wound workpiece 90 (decreasing the diameter of the ring or helix). Each of the cathodes 1 and anodes 3 has a vertically elongated shape (a shape extending in the axial direction of the annular or helical shape of the workpiece 90 held by the holding mechanism 2). The inward-facing surface of each cathode 1 works as a workpiece support surface against which the workpiece 90 is pressed by an outward acts of the elastic restoring force. The rotation mechanism 4 is configured to rotate at least either the workpiece 90 held by the holding mechanism 2 and cathodes 1, or the anodes 3, or both, around the axis of the annular or helical shape of the workpiece 90. Although the workpiece 90 and cathodes 1 are rotated in this embodiment, the anodes 3 may be rotated instead. Additionally, the workpiece 90 and cathodes 1 may be rotated in one direction while the anodes 3 are rotated in the opposite direction.

The workpiece 90 is a linear or strip-shaped wire rod which is applied the plating treatment and is annularly or helically wound. In this embodiment, the workpiece 90 is wound helically. Since the workpiece 90 is wound annularly or helically, the workpiece 90 is held while being pressed against the cathodes 1 by the elastic restoring force (the resilience that acts so as to expand the diameter of the wound workpiece 90 as a reactive force of the elastic deformation) which acts outward in the radial direction of the annular or helical shape. The workpiece 90 is contained together with a plating solution inside the plating tank 9. In this embodiment, the workpiece 90 is a linear wire rod made from stainless steel (SUS304) with a diameter of about 5 mm and a full length of about 15 m.

The cathodes 1 (1*a* to 1*f*) are annularly arranged at intervals in the circumferential direction of the workpiece 90 held by the holding mechanism 2 inside the plating tank 9 configured to contain a plating solution. The inward-facing surface of each annularly arranged cathode 1 composes as a workpiece support surface against the workpiece 90 which is pressed by an outward act of the elastic restoring force. In this embodiment, six cathodes, 1*a* to 1*f*, are annularly arranged at regular intervals. In this embodiment, the cathodes 1 are vertically elongated rod-shaped members and made from a conductive noble metal, such as platinum or gold. In order to reduce the contact area with the workpiece 90 (i.e., the area of the contact points), cathodes 1 are preferably rod-shaped members with a substantially circular cross section. A predetermined voltage necessary for plating treatment is applied to each cathode 1 through electrical wiring (not shown).

The holding mechanism 2 holds the cathodes 1 (1*a* to 1*f*) with the cathodes 1 spaced from each other and annularly arranged. The holding mechanism 2 includes a plurality of holding members 21 and a ring member 22.

The holding members 21 are rod-shaped members configured to individually support (hold) each cathode 1 from the outer side, and their shapes are vertically elongated which are annularly arranged. The ring member 22 is an annular member configured to hold the holding members 21 as a string (as a set) at their upper end. This allows the holding members 21 to individually hold each annularly arranged cathode 1 spaced from each other from the outer side. In this embodiment, the holding members 21 and the ring member 22 are formed of an insulating material, such as vinyl chloride.

The holding mechanism 2 may further include a ring member 29 at the bottom as an optional component. The ring member 29 at the bottom is an annular member configured to hold the holding members 21 as a string (as a set) at their lower end. The holding mechanism 2 including the ring member 29 at the bottom has an increased holding force with which the holding members 21 hold each cathode 1. The ring member 29 at the bottom may be formed of an insulating material, such as vinyl chloride.

The holding mechanism 2 further includes a boss 23 positioned substantially at the center of the ring m ember 22, a plurality of arms 24 radially extending from the boss 23 (arm members), and a shaft 25 extending from the boss 23 in the vertical direction. The arms 24 radially extend from the axial center of the workpiece 90 held by the holding mechanism 2 toward the outer periphery. The arms 24 are each connected at their base end to the boss 23 (rotation center portion) and each connected at their tip part to the ring member 22. In other words, the arms 24 are connected at their base end to the rotation mechanism 4 via the boss 23 and the shaft 25. The ring member 22 rotates with the rotation of the shaft 25. This allows the holding members 21 and the cathodes 1 to revolve around the shaft 25.

The anodes 3 are positioned at a place having a sufficient space to place the workpiece 90 which is a substrate, and such anodes are placed on the inner side of the cathodes 1 (1*a* to 1*f*) arranged inside the plating tank 9. The anodes 3 are formed of the same metal as that of the plating layer to be formed on the workpiece 90. In this embodiment, the anodes 3 are formed of copper, for example. A predetermined voltage necessary for plating treatment is applied to the anodes 3 through electrical wiring (not shown).

The anodes 3 are placed on the inner periphery side of the workpiece 90 held by the holding mechanism 2. Specifically, each of the anodes 3 include a first anode piece 31, a second anode piece 32, and a connecting part 33. In this embodiment, the first anode piece 31 and the second anode piece 32 are vertically elongated plate members (extending in the vertical direction) and are connected to each other at their lower end through the connecting part 33 which is in a plate shape. In this embodiment, the first anode piece 31, the second anode piece 32, and the connecting part 33 are integrated and formed of the same metal.

At least a pair of the anodes 3 is placed at positions facing each other across the axial center of the wound workpiece 90 held by the holding mechanism 2. Specifically, a set of the first anode piece 31 and the second anode piece 32 is placed at a position facing another set of the first anode piece 31 and the second anode piece 32 being opposite through the center of the ring. Preferably, a set of the first anode piece 31 and the second anode piece 32 is positioned 180° apart from another set of the first anode piece 31 and the second anode piece 32 being opposite through the center of the ring (those locations are diametrically opposite to each other).

The first anode pieces 31 are each placed at a position facing the cathodes 1 via the workpiece 90 inside the plating tank 9. The second anode pieces 32 are each placed at a position facing the cathodes 1 via the holding member 21 of the holding mechanism 2 inside the plating tank 9. Specifically, the first anode pieces 31 are each placed on the inner side of the helix shaped by the wound workpiece 90, and the second anode pieces 32 are placed on the outer side of the helix.

Of the first anode piece 31 and the second anode piece 32 that constitute each anode 3, the second anode piece 32 is not an essential component. The electrode that constitutes each anode 3 may be at least one electrode placed at a position facing a cathode 1 through the workpiece 90.

The rotation mechanism 4 is configured to rotate at least either the cathodes 1 or the anodes 3 around the center of the ring as a rotation center. In this embodiment, the position of each anode 3 does not move in the circumferential direction of the ring, and the rotation mechanism 4 rotates the ring member 22 with the shaft 25 as a rotation center so that the cathodes 1 supported from the outer side by the corresponding holding members 21 and the workpiece 90 supported by the cathodes 1 are able to rotate together. In this embodiment, the rotation mechanism 4 is an electric motor, which rotates the ring member 22 at a rotation speed of about 10 to 30 rpm under inverter control.

Figure 3:
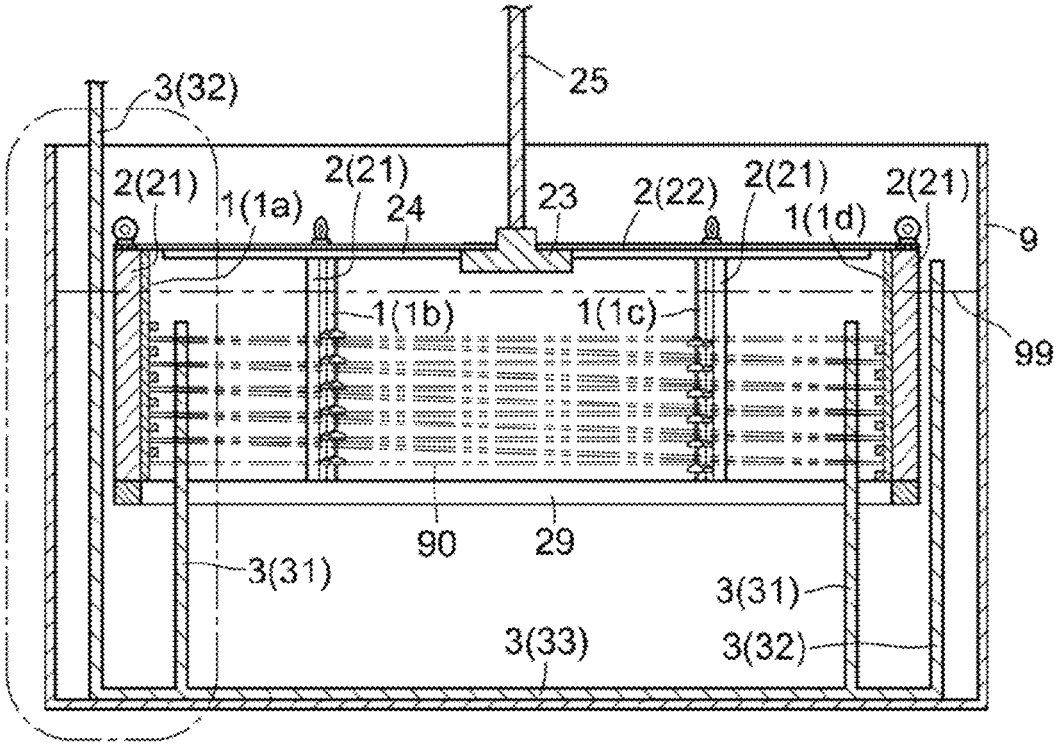
FIG. 3 is a cross-sectional view along the X1-X1 line in FIG. 2.

The plating tank 9 is configured to contain a plating solution. Inside the plating tank 9, the cathodes 1, the holding mechanism 2, the anodes 3, and the workpiece 90 are placed so that the whole or part of each is soaked in the plating solution. FIG. 3 shows an example of liquid level 99 of the plating solution indicated by a double-dotted line. In this embodiment, the plating tank 9 is a container made of an insulating material with no top, and the plating solution for use is a copper pyrophosphate plating bath.

The plating apparatus 10 may further include a reciprocating mechanism 5, a stirring mechanism 6, and a circulation mechanism 7 as optional components.

The reciprocating mechanism 5 is connected to the anodes 3 via an insulation member 51 and is configured to reciprocate the anodes 3 in the radial direction of the ring (i.e., along the radial direction of the annular or helical shape of the workpiece 90 held by the holding mechanism 2). In an embodiment, the reciprocating mechanism 5 includes a crank and an electric motor, and reciprocates the anodes 3 in the radial direction of the ring within a range of about 30 mm to 50 mm. The reciprocating mechanism 5 is also referred to as a "swing mechanism," and can form a more precise plating layer by reciprocating or swinging the anodes 3.

The stirring mechanism 6 is configured to inject gas into the plating solution contained in the plating tank 9 through an injection path 61 to thereby stir the plating solution. Preferably, the injection path 61 is annularly positioned under the ring member 22 in the plating tank 9. In an embodiment, the stirring mechanism 6 is an air pump. A more precise plating layer can be formed by stirring the plating solution.

The circulation mechanism 7 is configured to circulate the plating solution contained in the plating tank 9. In an embodiment, the circulation mechanism 7 is a fluid circulation pump equipped with a filtration function. Circulating the plating solution in the plating tank 9 removes impurities such as fine particles in the plating solution and allows for the formation of a more precise plating layer.

Figure 5:
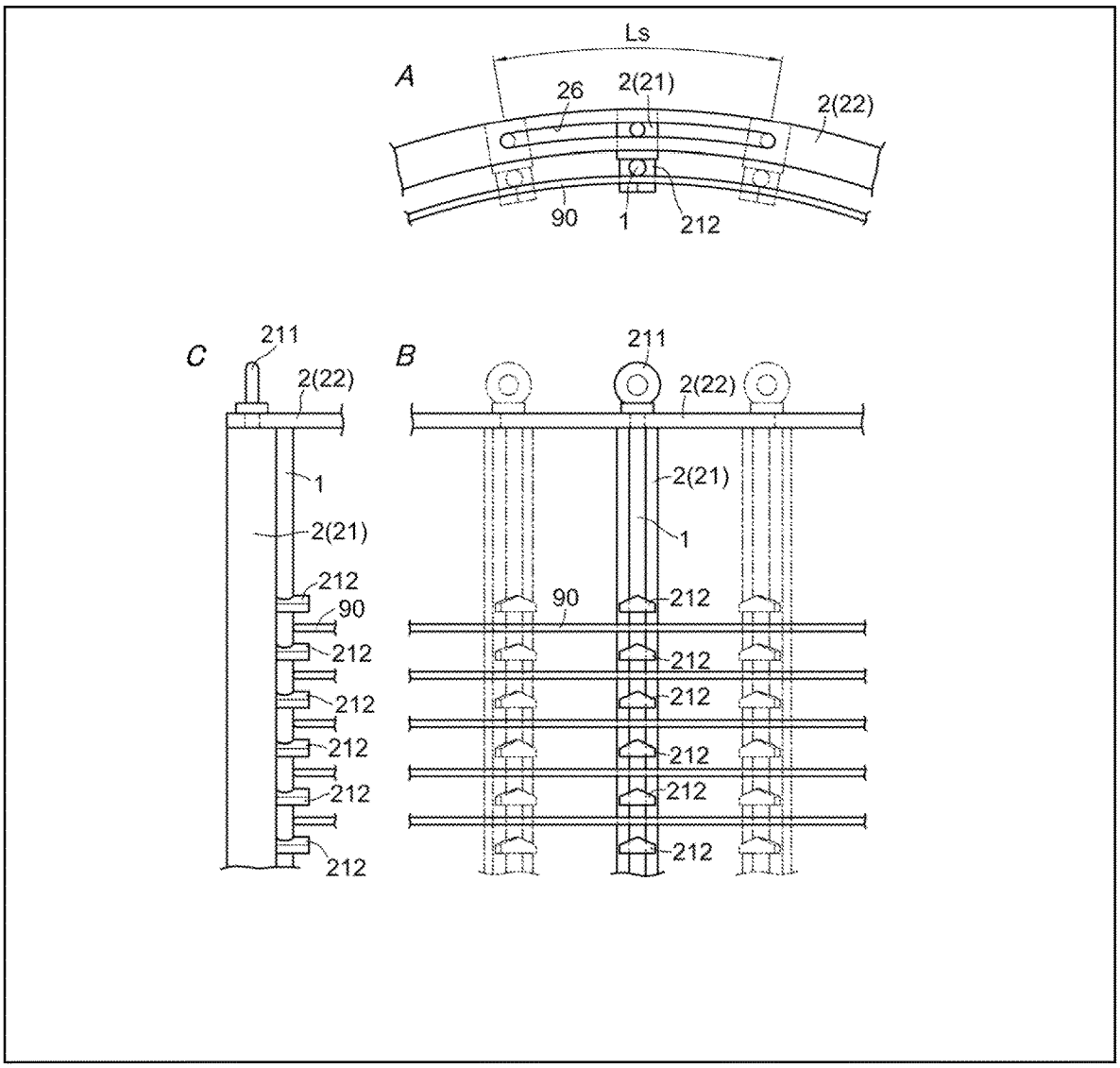
FIG. 5 is an enlarged view of the part containing a holding member and a ring member shown in FIGS. 1 and 4.

FIG. 5 is an enlarged view of a section containing the holding member and the ring member shown in FIGS. 1 to 4. In FIG. 5, FIG. 5A is a plan view of the holding member 21 and the ring member 22, FIG. 5B is the holding member 21 viewed from the inner side of the ring in the radial direction, and FIG. 5C is the holding member 21 viewed along a tangent line on the circumferential direction of the ring. In FIG. 5A, for convenience of explanation, a fastener 211 is not shown.

The ring member 22 includes a mechanism configured to change the holding positions at which individual holding members 21 are held in the circumferential direction (the circumferential direction of the workpiece 90 held by the holding mechanism 2). The mechanism configured to change the holding positions is achieved, for example, by slits 26 and fasteners 211, which are described later. Specifically, a fastener 211 is attached at the upper end of each holding member 21. The attaching position at the upper end of each holding member 21 can be changed by loosening the corresponding fastener 211. A slit 26 provided in the circumferential direction of the ring member 22 is attached at the position in the ring member 22 at which the upper end of the holding member 21 is attached. In this manner, the holding members 21 are each attached to the ring member 22 such that the upper end of each holding member 21 is movable in the circumferential direction. The movement of the upper end of each holding member 21 in the circumferential direction changes the contact point between the workpiece 90 and the corresponding cathode 1. The length "$L_s$" of each slit 26 in the circumferential direction is, for example, about 50 mm to about 80 mm.

Each of the rod-shaped holding members 21 includes a plurality of protrusions 212 placed at predetermined intervals in the vertical direction. The protrusions 212 are formed of an insulating material, such as vinyl chloride, and preferably formed of the same material as that of the holding members 21. The protrusions 212 allow the helically wound workpiece 90 to be positioned such that the wound sections of the wire rod do not contact each other. The wound sections of the wire rod may be in contact with the protrusions 212.

(2) Procedure of Treatment

The following describes plating treatment using the plating apparatus according to an embodiment of the present invention. The plating method according to an embodiment of the present invention includes the step of holding cathodes at positions electrically connected to the outer periphery of the annularly or helically wound substrate (a material to be plated) in a plating tank configured to contain a plating solution; the step of holding the substrate via the cathodes from the outer periphery side of the substrate with the substrate being elastically deformed to reduce the diameter of the wound substrate; the step of rotating at least either the held substrate and cathodes or at least one anode placed on an inner periphery side of the substrate, or both, around the axis of the wound substrate; and the step of conducting the plating treatment on the substrate by applying an electric current across the cathodes and the anode while performing the rotating step.

Specifically, first, a linear or strip-shaped wire rod 90 (workpiece 90) applied the plating treatment is annularly or helically wound. In this embodiment, the workpiece 90 is helically wound.

Next, the helically wound wire rod 90 is placed on the inner side of a ring shaped by annularly arranged cathodes 1*a* to 1*f* as the wound wire rod 90 is contracted such that the diameter of the helix shaped by the wire rod 90 is slightly shorter than the diameter of the ring shaped by the annularly arranged cathodes 1*a* to 1*f*. After the wire rod 90 is positioned on the inner side of the ring, the contraction of the diameter of the helix is released. Subsequently, because of an outward relaxation generated from the elastic restoring force of the helically wound wire rod 90, it presses the wire rod 90 against the inward-facing surface of the cathodes 1*a* to 1*f*. Thus, the wire rod 90 is positioned on the inner side of the cathode 1*a* to 1*f* and comes into contact with the cathodes 1 to be electrically connected to the cathodes 1.

Next, the rotation mechanism 4 is activated to rotate the ring member 22 with the shaft 25 as a rotation center. Because of this, the cathodes 1 supported by the holding members 21 and the wire rod 90 supported by the cathodes 1 are able to rotate together with the center of the ring as a rotation center. The rotation mechanism 4 continuously operates during the plating treatment.

Next, a predetermined voltage is applied across the cathodes 1 and the anode (electric current application) to perform plating treatment on the wire rod 90.

In an optional step, the positions at which the wire rod 90 is pressed against the cathodes 1 (the positions at which the cathodes 1 are electrically connected to the wire rod 90) may be changed every predetermined time. In this case, the contact positions between the workpiece 90 and the cathodes 1 are changed by using the slits 26 which is provided on the ring member 22, along the circumferential direction. By making each of the cathodes 1 enables to move in the radial direction, the cathodes 1*a* to 1*f* which are pressed against the wire rod 90 may be divided into a plurality of groups; then, the group of cathodes 1 to be come into contact with the wire rod 9 can be replaced with the other group every predetermined time.

Figure 2:
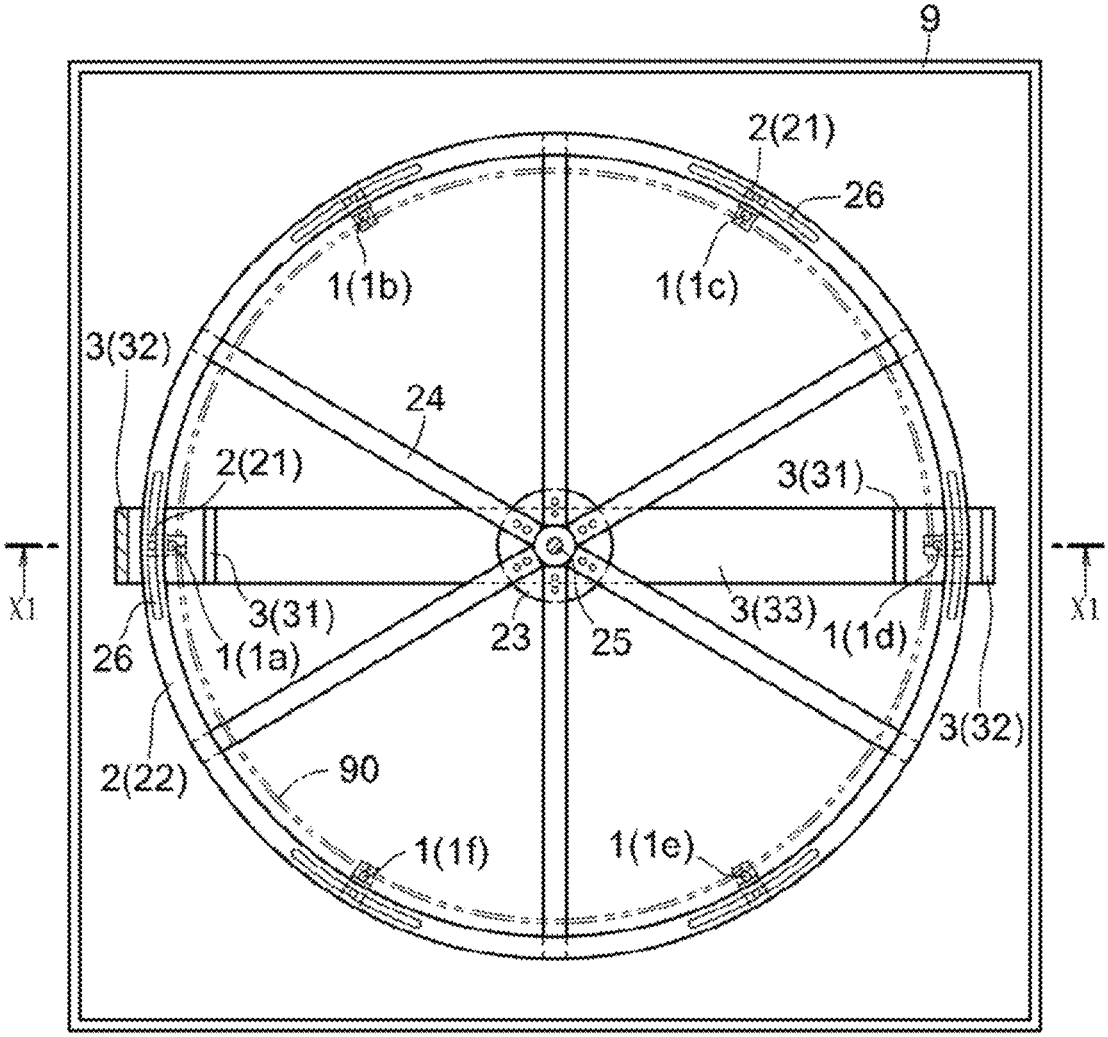
FIG. 2 is a plan view of a plating apparatus in an embodiment of the present invention.

For example, of the six cathodes 1*a* to 1*f* arranged at substantially equal intervals shown in FIGS. 1 to 3, three cathodes, 1*a*, 1*c*, and 1*e*, are determined to be the first group, and the other three cathodes, 1*b*, 1*d*, and 1*f*, are determined to be the second group. For example, when the group of cathodes 1 to be brought into contact with the wire rod 90 is changed every 5 minutes, the first plating treatment is performed for the first 5 minutes by using the three cathodes that belong to the first group (1*a*, 1*c*, and 1*e*) while the wire rod 90 is held in a steady position, and then the next plating treatment is performed for the following 5 minutes by using the three cathodes that belong to the second group (1*b*, 1*d*, and 1*f*) while the wire rod 90 is held in a steady position. Subsequently, in the same manner, plating treatment is performed for the following 5 minutes by using the three cathodes that belong to the first group (1*a*, 1*c*, and 1*e*) while the wire rod 90 is held in a steady position, and then plating treatment is performed for the following 5 minutes by using the three cathodes that belong to the second group (1*b*, 1*d*, and 1*f*) while the wire rod 90 is held in a steady position. Sine this operation allows an operator to change the contact points between the wire rod 90 and the cathodes 1 every predetermined time, a more precise plating layer can be formed.

(3) Effect of Embodiment

In the plating apparatus according to the embodiment described above, the workpiece 90 (substrate) is helically wound and held while being pressed against the cathodes 1*a* to 1*f* by an outward force generated from the elastic restoring force in the radial direction of the helix. This can reduce the size of the plating tank 9. Additionally, the annular arrangement of the cathodes 1*a* to 1*f* spaced from each other can reduce the area of the contact points between the workpiece 90 and the cathodes 1, and thus, it can form a high-precision plating layer.

Since a decrease in size of the plating tank 9 can reduce the variable (unevenness) in the agitation or circulation of the plating solution, even a relatively long wire rod can have fewer variables in the precision to produce the plating layer. Additionally, a decrease in area of the contact points between the workpiece 90 and cathodes 1 can reduce variables in the precision to produce the plating layer. This can increase the yield of the workpiece 90.

The plating apparatus 10 in the embodiment described above can form a more precise plating layer by further including the reciprocating mechanism 5, the stirring mechanism 6, and the circulation mechanism 7. Reciprocating or oscillating the anodes 3 using the reciprocating mechanism 5 can form a more precise plating layer. Agitating or filtering, and/or circulating the plating solution by using the stirring mechanism 6 or the circulation mechanism 7 can form a more precise plating layer.

(4) Other Embodiments

Although a specific embodiment of the present invention is described above, the present invention is not limited to this embodiment.

In the embodiment above, the rod-shaped holding member 21 includes the protrusions 212 spaced apart in the vertical direction. However, instead of the protrusions 212 on the holding member 21, horizontally dented grooves may be provided to the rod-shaped cathodes 1 in the vertical direction. It is sufficient if the helically wound workpiece 90 is placed such that the wound sections of the wire rod are not in contact with each other. The wound sections of the wire rod may be held inside the grooves provided to the cathodes 1.

Figure 6:
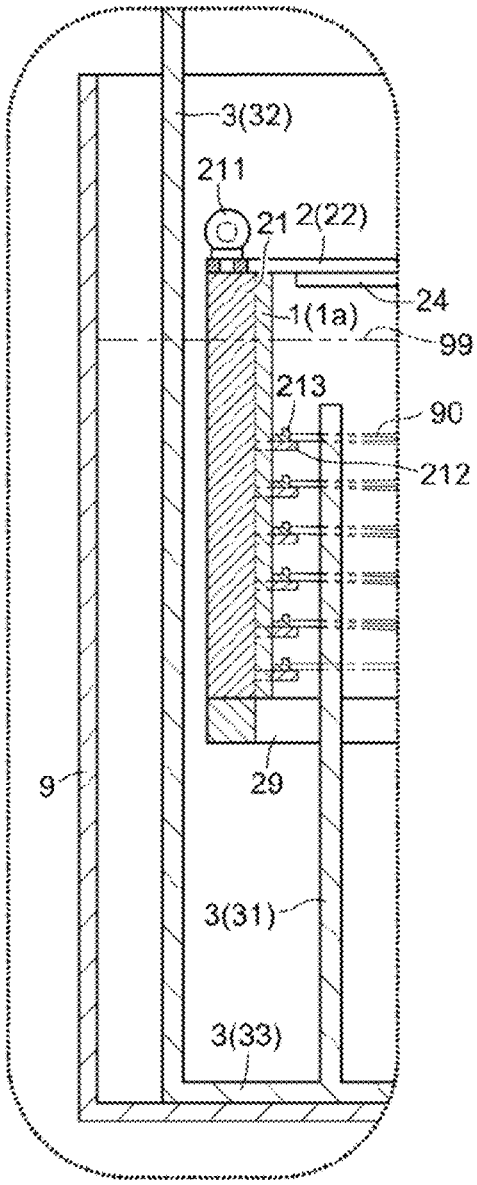
FIG. 6 is an enlarged view of the part containing a holding member and a ring member in another embodiment.

In the embodiment described above, as shown in FIG. 4, the workpiece 90 is directly pressed against the inward-facing workpiece support surface of the cathodes 1. However, as shown in FIG. 6, the workpiece 90 may be indirectly pressed against the workpiece support surface via conductive jigs 213. In the example embodiment shown in FIG. 6, substantially L-shaped jigs 213 in the side view are provided on the protrusions 212 of the holding member 21, and the workpiece 90 is indirectly pressed against the cathodes 1 via the jigs 213. This electrically connects the outer periphery of the workpiece 90 to the cathodes 1 via the jigs 213.

In the embodiment described above, the cathodes 1 rotate around the center of the ring as a rotation center via the ring member 22. However, the cathodes 1 may rotate via the ring member 29 at the bottom instead of the ring member 22. In this case, the ring member 29 at the bottom may include the boss 23, the arms 24, and the shaft 25, in the same manner as the ring member 22.

In the embodiment described above, the workpiece 90 to be applied plating treatment is a linear or strip-shaped wire rod. However, the wire rod includes a mineral-insulated (MI) cable, and the mineral-insulated cable may have the surface plated as the workpiece 90.

In the embodiment described above, the workpiece 90 (substrate) is plated with copper (plating layer). However, the metal for forming a plating layer is not limited to copper. Various metals can be used in plating by suitably selecting the metal for use in the anodes 3 and the plating solution. For example, the workpiece 90 can be plated with metal for the base before the workpiece 90 is plated with copper.

When the workpiece 90 is plated with copper, the workpiece 90 is applied a series of steps as follows: the step of degreasing the workpiece 90, the step of washing the workpiece 90 with water, the step of plating the workpiece 90 with a base metal, and the step of plating the workpiece 90 with copper. With the plating apparatus according to this embodiment, a series of these steps can be performed without removing the workpiece 90 from the holding mechanism 2. For example, four plating apparatuses 10 may be placed in a sequence of the four steps, and the plating tanks 9 are filled with a solvent, washing water, a plating solution for base metal plating, or a plating solution for copper plating according to the corresponding step. The workpiece 90 is held by the holding mechanism 2 before being applied to the first step (degreasing step). The workpiece 90 and the holding mechanism 2 can be moved between the plating tanks 9 provided for each step, and the workpiece 90 is given the plating treatments at each step in the corresponding plating tank 9. In this manner, the workpiece 90 held by the holding mechanism 2 can be undergone a series of steps, including the final cupper plating step, without being removed even once from the holding mechanism 2 throughout the four steps.

The plating method according to this embodiment can be applied to both a workpiece 90 having a partly provided masking area and a workpiece 90 having no masking area. The masking area is an area on which plating treatment is not performed and refers to an area covered by a masking material 8, described later with reference to FIG. 7. The plating method according to this embodiment can also be applied to a workpiece 90 to which a variety of surface treatment has been performed beforehand. Examples of the variety of surface treatment include forming a plating layer by various plating treatment methods, including the plating method according to this embodiment, and surface hardening treatment (case-hardening). For example, in the plating method according to this embodiment, the workpiece 90 can be the subject of plating treatment according to three embodiments described below as examples.

The workpiece according to the first embodiment has a partly provided masking area, and a plating layer is formed on the entire surface of the workpiece, excluding the masking area, by the plating method according to this embodiment. The workpiece according to the second embodiment has no masking area, and a plating layer is formed on the entire surface of the workpiece by the plating method according to this embodiment. The workpiece according to the third embodiment has a plating layer formed on the entire surface beforehand and also has a partly provided masking area. A plating layer being thicker than the plating layer at the masking area is formed on the entire surface of the workpiece, excluding the masking area, by the plating method according to this embodiment.

Figure 7:
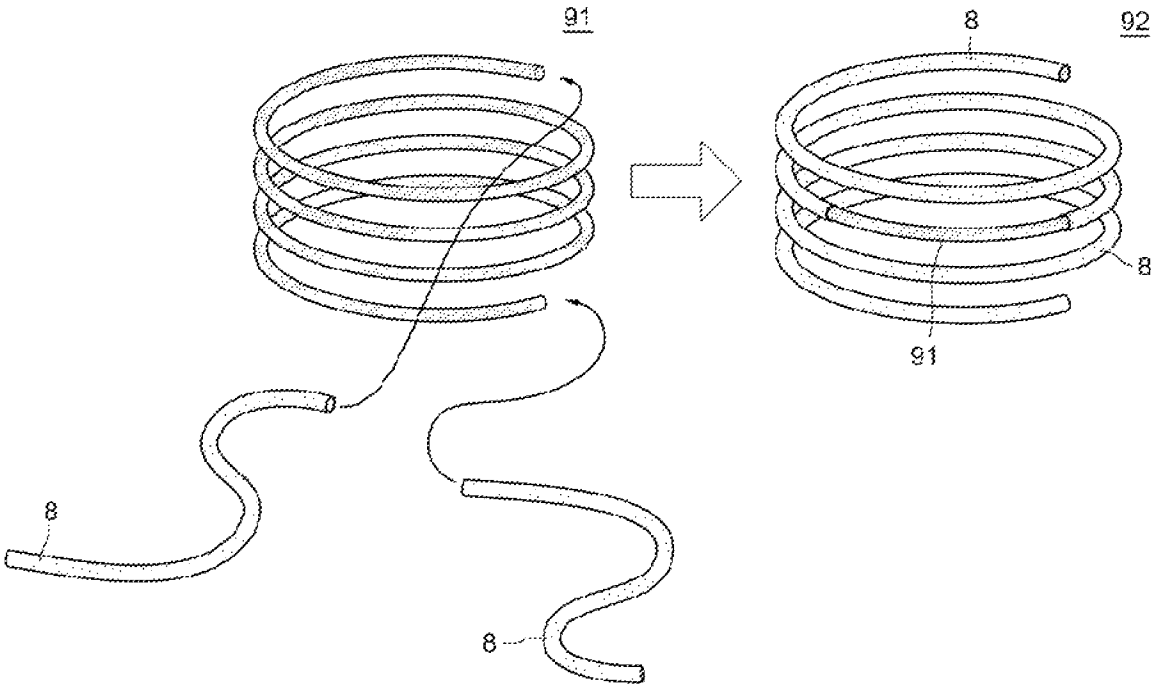
FIG. 7 is a schematic view of a workpiece having at least part of the surface covered by a masking material.

With reference to FIG. 7, the workpiece according to the third embodiment is described in detail. The workpiece according to the third embodiment is the workpiece 92 shown in FIG. 7, in which a masking area is partly provided. In the workpiece 92, the surface of the workpiece 91 is covered by the masking material 8 with part of the surface of the workpiece 91 exposed. The workpiece 91 has a plating layer (first plating layer) with a predetermined thickness formed on the entire surface. The plating layer on the surface of the workpiece 91 may be formed beforehand by the plating method according to this embodiment or formed beforehand by a method other than the plating method according to this embodiment. For example, if the plating layer on the surface of the workpiece 91 is formed by the plating method in this embodiment, the thickness of the plating layer on the surface of the workpiece 91 is about 5 μm±1 μm. When the plating method according to this embodiment is applied to the workpiece 92 in the third embodiment, the masking material 8 is removed from the workpiece 92. This allows a plating layer with a thickness of about 5 μm±1 μm formed beforehand on the surface of the workpiece 91 to be remained on the area selectively covered by the masking material 8 (masking area) and allows a thicker plating layer (second plating layer; e.g., about 100 μm) to be formed on the exposed area over which the masking material 8 does not cover (non-masking area). In the example shown in FIG. 7, there is only a single exposed area that is not covered by the masking material 8 in the workpiece 92; however, there may be multiple exposed surface areas.

The material for the masking material 8 is preferably insulating and highly adhesive to stick the workpiece 91,90. For example, a hollow cylindrical member made of an insulating elastomer, as shown in FIG. 7, or commercially available masking tape can be used for the masking material 8. The masking material 8 is preferably placed in contact with the workpiece 91,90.

In the embodiment described above, the workpiece 90 (substrate) is held in an annularly or helically wound shape by the plurality of cathodes 1 (1*a* to 1*f*). However, the number of the cathodes 1 for use in holding the workpiece 90 may be one. For example, of the six cathodes 1*a* to 1*f* shown in the plane view of FIG. 2, the five cathodes 1*b* to 1*f*, excluding the cathode 1*a*, may be replaced with an insulating elastic member having the same shape as that of the cathodes 1*b* to 1*f*. The workpiece 90 is held in an annularly or helically wound shape by the single cathode 1*a* and five elastic members, and a predetermined voltage necessary for plating treatment is applied to the workpiece 90 via the single cathode 1*a*.

EXAMPLES

Examples of the present invention are given below to further clarify the effects of the invention.

The object of the Examples was to form a plating layer with a thickness of 5 μm and a film thickness precision of ±1 The workpiece to be plated was a mineral-insulated (MI) cable (SUS304) with a diameter of 5 mm and a length of 15 m. The material used for holding members was a bar made of vinyl chloride. The material used for cathodes was a conductive metal rod made of iron, and the material used for anodes was a plate electrode made of copper. The workpiece was placed helically on the inner side of at least three conductive metal rods so as to come into contact with the conductive metal rods, followed by being combined with the bars to form a ring member. The workpiece and conductive metal rods were immersed in a plating solution in a plating tank, and then plating treatment was performed while the ring member was rotated with an inverter-controlled electric motor at a rotation speed of 10 to 30 rpm. The anodes were fixed positions and arranged in parallel within a range of 100 to 200 mm so that the ring member was at the center of the plate anodes facing each other in parallel. Plating treatment was performed by swinging the anodes in the radial direction of the ring member within a range of 30 to 50 mm to change the distance from the anodes to the center of the wound workpiece so that eccentricity caused by rotation was suppressed to achieve the uniform film thickness. A copper pyrophosphate bath was used as the plating solution. Rotational plating was performed under the conditions shown in Table 1.

TABLE 1

| | |
|---|---|
| Plating Solution | Copper Pyrophosphate Plating Bath Containing Gloss Agent |
| Sample | USU304, Diameter 5 × 15000 |
| Bath Temperature | 55° C. |
| Current Density | 1 A/dm$^2$ |
| Plating Time | 10 minutes |
| Rotation Speed of Anodes | 20 rpm |

Figure 8:
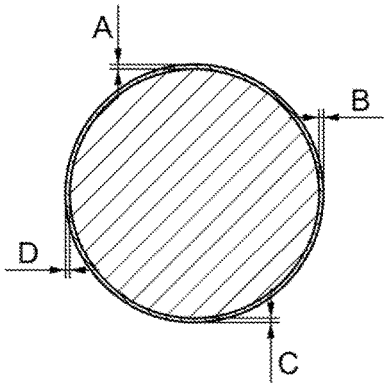
FIG. 8 is a view showing measurement points at which the coating thickness on the wire rod is measured.

The thickness of the film and the amount of surface defects were compared between the workpiece plated in the Example above and a workpiece plated by a drum copper plating method disclosed in PTL 2, which was prepared as a Comparison Example. FIG. 8 shows the points at which the film thickness of the workpieces was measured. Table 2 shows the results of comparison of the film thickness between the Example and Comparative Example.

TABLE 2

| | Cu Film Thickness (μm) | |
|---|---|---|
| Measurement Points | Example | Comparative Example |
| A | 4.668 | 4.542 |
| B | 4.808 | 9.362 |
| C | 5.047 | 6.182 |
| D | 5.187 | 3.036 |
| Difference in Film Thickness | 0.519 | 6.326 |

In the Comparative Example, the thickness of the formed film was largest at the measurement point B, while the thickness of the formed film was smallest at the measurement point D. In the Comparative Example, the maximum difference in thickness of the formed film was 6.326 μm. In the Example, the thickness of the formed film was largest at the measurement point D, and the thickness of the formed film was smallest at the measurement point A. In the Example, the maximum difference in thickness of the formed film was 0.519 μm. This indicated that the thickness of the coating layer was more uniform and even in the Example than in the Comparative Example. The thickness of the film formed in the Example was 5 μm±0.4 μm at any of measurement points A to D, achieving the target film thickness precision within ±1 μm.

Figure 9:
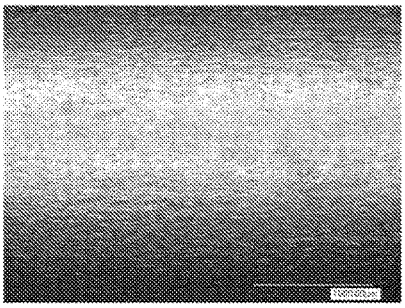
FIG. 9 shows images of observed coating layer surfaces.
Figure 9:
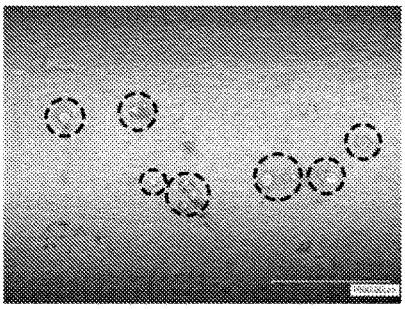

FIG. 9 shows images of the surface of the observed film layers. In FIG. 9, the sections indicated by dotted circles are the spots in which defects occurred. The image of the Example indicated as (a) had notably fewer defects on the surface than the image of the Comparative Example indicated as (b).

DESCRIPTION OF THE REFERENCE NUMERALS

1 (1*a*-1*f*) cathodes
2 holding mechanism
21 holding member
211 fastener
212 protrusion
213 jig
22 ring member
23 boss
24 arm
25 shaft
26 slit
29 ring member at the bottom
3 anode
31 first anode piece
32 second anode piece
33 connecting part
4 rotation mechanism
5 reciprocating mechanism (swing mechanism)
51 insulation member
6 stirring mechanism
61 introductory path
7 circulation mechanism
8 masking material
9 plating tank
10 plating apparatus
90,91,92 workpiece (wire rod)

The invention claimed is:

1. A plating apparatus comprising
a plating tank configured to contain an annularly or helically wound substrate together with a plating solution,
at least one cathode placed inside the plating tank,
a holding mechanism configured to hold the cathode at a position electrically connected to an outer periphery of the substrate and to hold the substrate via the cathode,
at least one anode placed on an inner periphery side of the substrate held by the holding mechanism, and
a rotation mechanism configured to rotate at least either the substrate and cathode held by the holding mechanism or the anode, or both, around an axis of the wound substrate.

2. The plating apparatus according to claim 1, wherein the holding mechanism is configured to hold the substrate from an outer periphery side of the substrate via the cathode with the substrate being elastically deformed to reduce the diameter of the wound substrate.

3. The plating apparatus according to claim 2, wherein
the at least one cathode is a plurality of cathodes,
the holding mechanism is configured to hold the plurality of cathodes spaced from each other in the circumferential direction of the substrate held by the holding mechanism, and
each of the cathodes has a shape extending in the axial direction of the wound substrate held by the holding mechanism.

4. The plating apparatus according to claim 3, wherein the holding mechanism includes a plurality of holding members configured to individually hold each cathode and an annularly structured ring member that integrally holds the holding members spaced from each other in the circumferential direction.

5. The plating apparatus according to claim 4, wherein the substrate is either a material having a partly provided masking area or a material having no masking area.

6. The plating apparatus according to claim 1, wherein
the at least one cathode is a plurality of cathodes,
the holding mechanism is configured to hold the plurality of cathodes spaced from each other in the circumferential direction of the substrate held by the holding mechanism, and
each of the cathodes has a shape extending in the axial direction of the wound substrate held by the holding mechanism.

7. The plating apparatus according to claim 6, wherein the holding mechanism includes a plurality of holding members configured to individually hold each cathode and an annularly structured ring member that integrally holds the holding members spaced from each other in the circumferential direction.

8. The plating apparatus according to claim 1, wherein the substrate is either a material having a partly provided masking area or a material having no masking area.

9. The plating apparatus according to claim 2, wherein the substrate is either a material having a partly provided masking area or a material having no masking area.

10. The plating apparatus according to claim 6, wherein the substrate is either a material having a partly provided masking area or a material having no masking area.

11. The plating apparatus according to claim 3, wherein the substrate is either a material having a partly provided masking area or a material having no masking area.

12. The plating apparatus according to claim 7, wherein the substrate is either a material having a partly provided masking area or a material having no masking area.

* * * * *